US012674643B2

(12) United States Patent
Culton et al.

(10) Patent No.: US 12,674,643 B2
(45) Date of Patent: Jul. 7, 2026

(54) CARRY BAG FOR MULTIPLE RIFLES

(71) Applicants: Corey J. C. Culton, Paradise, CA (US); Steven E. Culton, Jr., Chico, CA (US)

(72) Inventors: Corey J. C. Culton, Paradise, CA (US); Steven E. Culton, Jr., Chico, CA (US)

(73) Assignee: Rifle Roll LLC, Chico, CA (US)

( * ) Notice: Subject to any disclaimer, the term of this patent is extended or adjusted under 35 U.S.C. 154(b) by 227 days.

(21) Appl. No.: 17/971,090

(22) Filed: Oct. 21, 2022

(65) Prior Publication Data

US 2023/0045823 A1 Feb. 16, 2023

Related U.S. Application Data

(63) Continuation-in-part of application No. 16/560,162, filed on Sep. 4, 2019, now abandoned.

(51) Int. Cl.
*A45C 11/24* (2006.01)
*A45C 7/00* (2006.01)
(Continued)

(52) U.S. Cl.
CPC ..... *F41C 33/06* (2013.01)

(58) Field of Classification Search
CPC ..... A45C 11/00; A45C 11/02; A45C 11/24; A45C 11/26; A45C 11/38; A45C 13/001; A45C 13/02; A45C 13/03; A45C 13/04; A45C 13/103; A45C 13/1069; A45C 13/26; A45C 13/28; A45C 13/30; A45C 13/40; A45C 15/00; A45C 2001/022; A45C 2003/002; A45C 2003/007; A45C 2007/0004; A45C 2011/002;
(Continued)

(56) References Cited

U.S. PATENT DOCUMENTS 2,813,669 A * 11/1957 Frieder ..... F42B 39/02 224/663
4,715,499 A * 12/1987 Franklin ..... A45C 11/26 206/459.5
(Continued)

FOREIGN PATENT DOCUMENTS

EP 0688725 A1 * 12/1995 ..... A45C 11/26
WO WO-2018038592 A1 * 3/2018 ..... A45C 11/26

OTHER PUBLICATIONS

AmazonDOTcom, VISM by NcStar Rifle Case Shooting Mat, Date First Available = Feb. 20, 2010, ASIN B003G32308 (Year: 2010).*
(Continued)

*Primary Examiner* — Anthony D Stashick
*Assistant Examiner* — Marcos Javier Rodriguez Molina
(74) *Attorney, Agent, or Firm* — Olav M. Underdal; IDP Patent Services

(57) ABSTRACT

A rifle carry bag includes: a bag body with rifle pockets positioned side by side, each with a bottom mounted ballistic pouch, optionally with gaps between each adjacent pair of rifle pockets, such that the bag body can be rolled up with rifles inside and locked with padlocks secured to d-rings; at least one strap assembly, including an elongated strap and first and second strap couples; a pair of handles; exterior and interior accessory pockets; an elbow pad; and optionally a shoulder strap.

19 Claims, 14 Drawing Sheets

(51) Int. Cl.

| | |
|---|---|
| ***A45C 11/26*** | (2006.01) |
| ***A45F 3/02*** | (2006.01) |
| ***F41C 33/06*** | (2006.01) |

(58) Field of Classification Search

CPC ..... A45C 2011/003; A45C 2013/026; A45C 3/00; A45C 3/001; A45C 3/004; A45C 3/06; A45C 3/12; A45C 5/00; A45C 5/14; A45C 7/0022; A45C 7/0031; A45C 7/0036; A45C 7/0045; A45C 7/0059; A45C 7/0063; A45C 7/0068; A45C 7/0095; A45C 9/00; A45C 11/22; A45C 11/32; A45F 2200/0591; A45F 3/02; F41C 33/06; F41C 33/02

USPC ..... 206/204, 279, 287.1, 289, 3, 305, 315.1, 206/315.11, 317, 320, 349, 373, 389, 438, 206/511, 521, 522, 523, 525, 528, 561, 8, 206/814

See application file for complete search history.

(56) References Cited

U.S. PATENT DOCUMENTS

| | | | | |
|---|---|---|---|---|
| 4,738,547 | A * | 4/1988 | Brown | A45C 7/0095 383/119 |
| 4,877,131 | A * | 10/1989 | Patros | F41C 33/06 224/913 |
| 6,267,277 | B1 * | 7/2001 | Taylor | B25H 3/04 224/183 |
| 2004/0222125 | A1 * | 11/2004 | Meing | A45C 11/26 206/581 |
| 2005/0241208 | A1 * | 11/2005 | Ditchfield | F41C 33/0218 89/36.01 |
| 2008/0105573 | A1 * | 5/2008 | Gonzales | G11B 33/0422 206/308.1 |
| 2016/0286777 | A1 * | 10/2016 | Potempa | A47G 9/0207 |
| 2017/0095048 | A1 * | 4/2017 | Kohn | A45C 11/26 |
| 2017/0354216 | A1 * | 12/2017 | Chernoff | A45C 13/008 |

OTHER PUBLICATIONS

Reviewer: JDIMONTE4, Rifle Case Shooting Mat, Amazon.com, ASIN: B003G32308 (Year: 2012).*

* cited by examiner

Rifle Carry Bag

CARRY BAG FOR MULTIPLE RIFLES

CROSS-REFERENCE TO RELATED APPLICATIONS

This U.S. Non-Provisional Application is a Continuation-In-Part of U.S. Non-Provisional application Ser. No. 16/560,162, filed Sep. 4, 2019; which is hereby incorporated herein by reference in its entirety.

FIELD OF THE INVENTION

The present invention relates generally to the field of cases and bags for storing and transporting rifles, and more particularly to methods and systems for storing and transporting a plurality of rifles.

BACKGROUND OF THE INVENTION

There are a multitude of cases and bags available to carry long-guns along with their accessories. However, there are few, if any cases designed to store and carry multiple long guns. Therefore, gun owners are generally forced to transport multiple large and bulky cases, for example when wanting to bring several firearms to a target range.

As such, considering the foregoing, it may be appreciated that there continues to be a need for novel and improved devices and methods for rifle cases adapted to store multiple rifles.

SUMMARY OF THE INVENTION

The foregoing needs are met, to a great extent, by the present invention, wherein in aspects of this invention, enhancements are provided to the existing model of rifle cases and bags.

In a related aspect, a rifle carry bag can include:

a) a bag body, which can include a plurality of rifle pockets, which are connected side by side, along a longitudinal direction of the rifle pockets, such that each rifle pocket in the plurality of rifle pockets can receive a rifle;

such that the rifle carry bag is configured to be rolled up in a lateral direction, when the rifle pockets are filled up with a corresponding plurality of rifles.

In a related aspect, the rifle carry bag can further include:

a) a plurality of gaps, which are positioned between each pair of rifle pockets.

In a related aspect, each gap in the plurality of gaps can have a width in a range of 0.635-25.4 centimeter (0.25-10 inches).

In a related aspect, each gap in the plurality of gaps can have a progressively increasing width from a right to a left side of the rifle carry bag.

In a related aspect, an outermost gap can have a width, which is at least 2.54 centimeter (1 inch) wider than other gaps in the plurality of gaps.

In a related aspect, the rifle carry bag can be made from a plastic material with a ballistic weave. The plastic material can for example be made from nylon or polyester, or a combination of these.

In a related aspect, the plastic material can include a nylon material.

In a related aspect, the rifle carry bag can have five rifle pockets.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
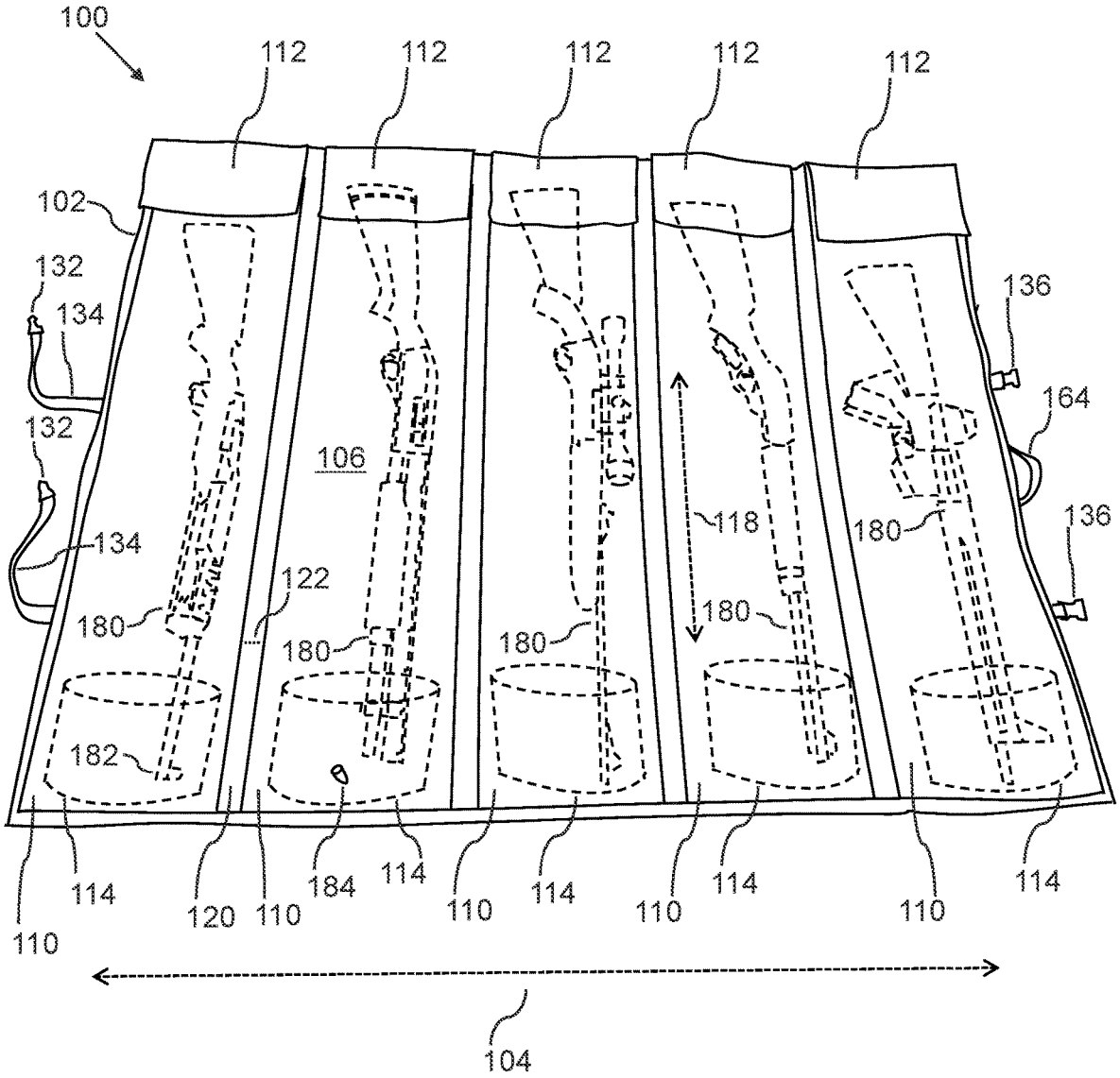
FIG. 1 is an inner side perspective view of a carry bag for rifles in a folded-out configuration, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a rifle carry bag 100 with reference to FIG. 1, in such manner that like reference numerals refer to like components throughout; a convention that we shall employ for the remainder of this specification.

The purpose of the rifle carry bag 100 is to safely and easily transport a large number of firearms within a single, compact and practical rifle carry bag 100. When full, the rifle carry bag 100 can be stored inside a traditional gun safe, which may save the owner from having to remove each rifle from the safe and load them into separate cases, allowing for a convenient "grab and go" assembly during emergencies, or when preparing for transport.

Figure 6:
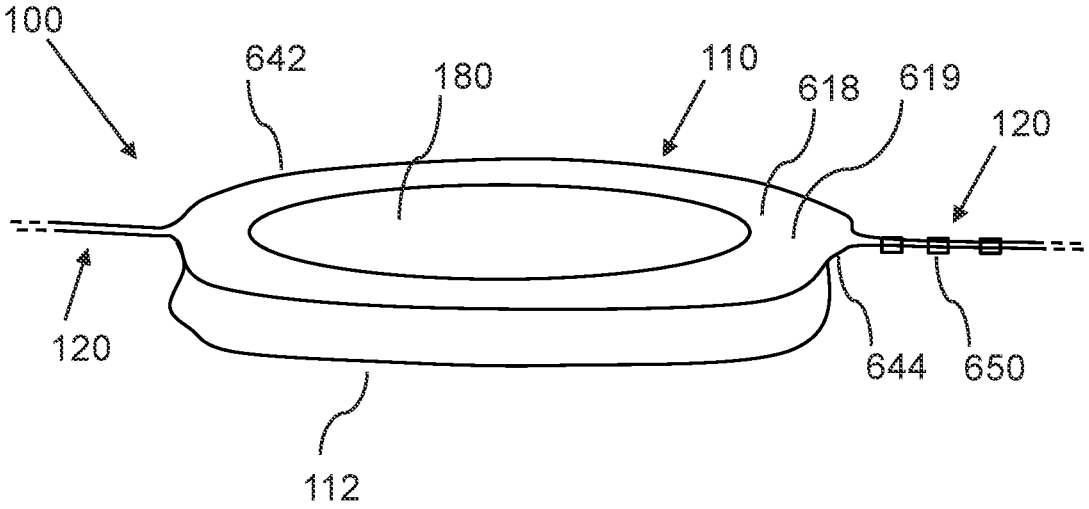
FIG. 6 is a front side view of part of a carry bag for rifles showing an opening into an interior of a rifle pocket, according to an embodiment of the invention.

In an embodiment, as shown in FIG. 1, a rifle carry bag 100, can include:

a) a plurality of rifle pockets 110, which are connected side by side, along a longitudinal direction/length of the pockets 110, such that each rifle pocket 110 is configured to receive a rifle 180;

wherein, as shown in FIG. 6, each rifle pocket can comprise a pocket interior 619, such that the rifle 180 is inserted through a pocket opening 618 into the pocket interior 619;

such that the rifle carry bag is configured to be rolled up in a lateral direction 104 (i.e. perpendicular to the longitudinal direction 118), when the rifle pockets are filled up with a corresponding plurality of rifles.

In a related embodiment, the rifle carry bag 100 can further include a plurality of gaps 120, between each adjacent pair of rifle pockets 110, wherein each gap 120 can have a width 122 in a range of 0.635-25.4 centimeter (0.25-10 inches).

In a related embodiment, each gap 120, can be progressively increasing in width, from a first to a second side (such as from left to right) in order to accommodate rolling up of the rifle carry bag 100.

In a related embodiment, as shown in FIG. 6, the rifle pockets 110 can be configured between two sheets of fabric 642, 644, such that a first fabric sheet 642 and second fabric sheet 644 can be stitched 650 together to form the gaps 120 or separation between pockets, when there are no gaps.

Figure 8:
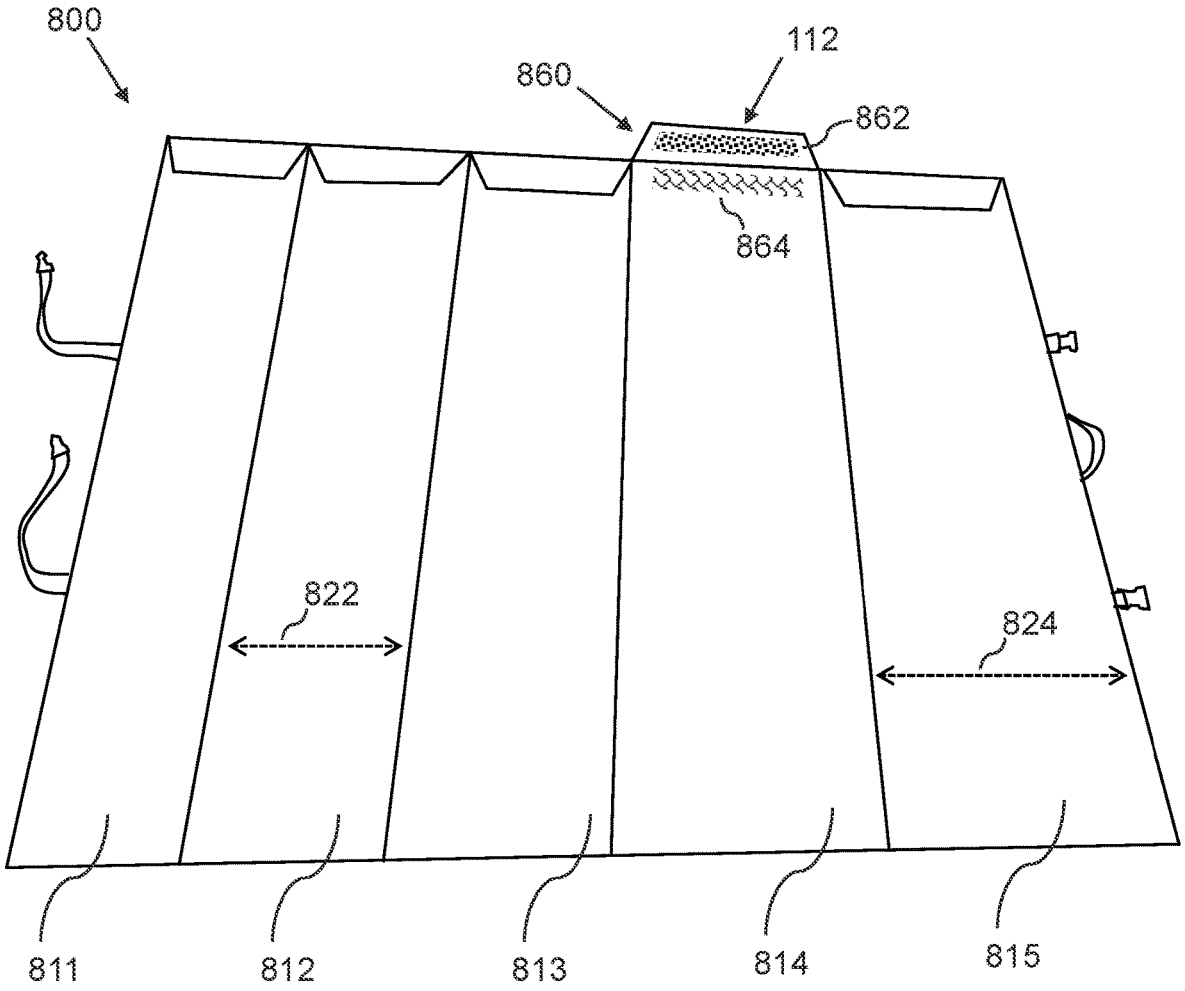
FIG. 8 is an inner side perspective view of a carry bag for rifles in a folded-out configuration, according to an embodiment of the invention.

In another related embodiment, each rifle pocket 110 can further include a pocket flap 112, which is configured to close the rifle pocket 110. The pocket flaps 112 can for example be securable with hook 862 and loop 864 fastener 860, as shown in FIG. 8.

In yet another related embodiment, the rifle carry bag 100 can be made from ballistic nylon and/or heavy-grade polyester, such as commonly used to make black acoustic guitar bags and soft long-gun carrying cases; and can be outfitted with similar foam padding, stitching, straps, handles, buckles and hook and loop fastener where needed.

Figure 2:
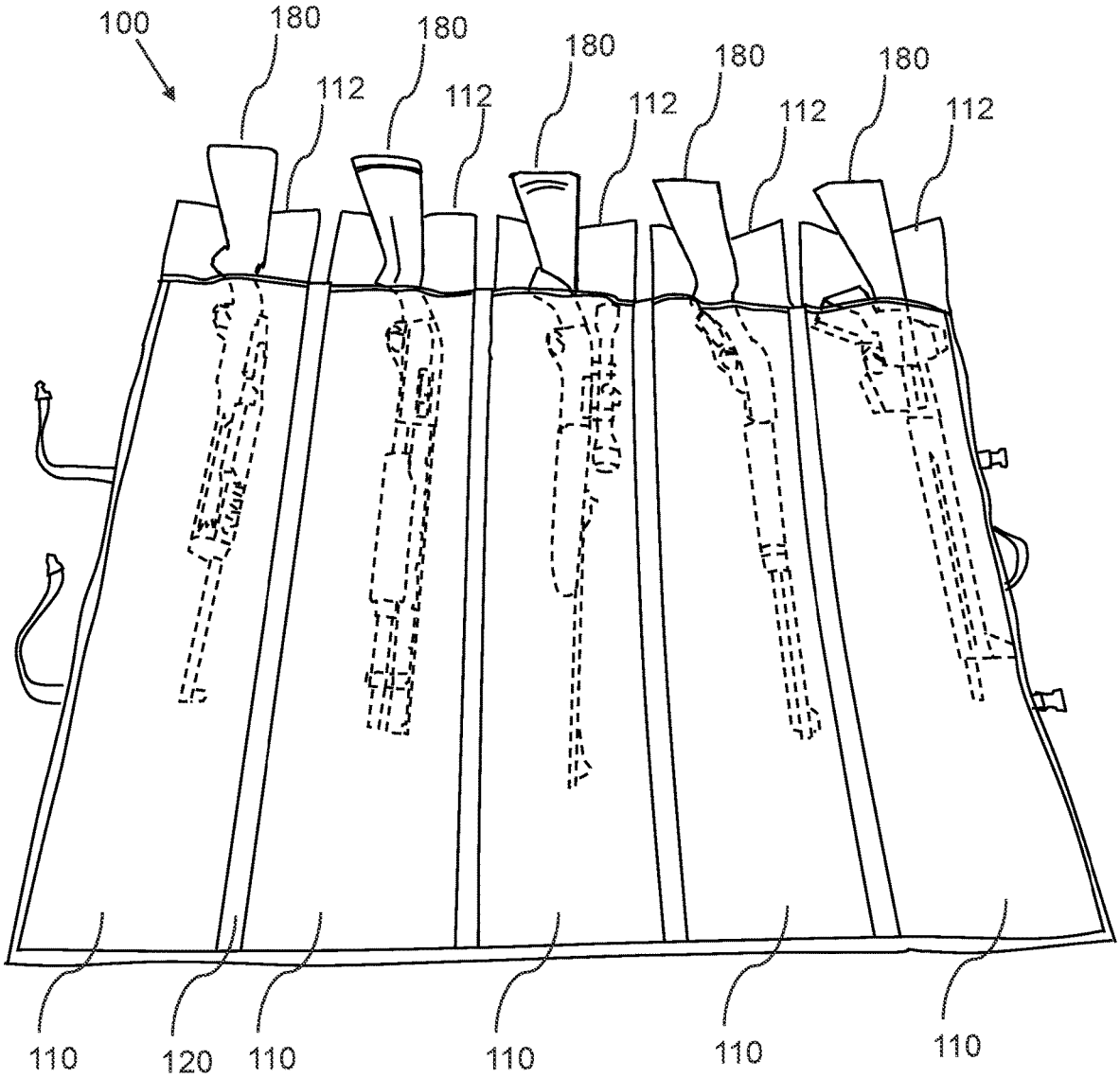
FIG. 2 is an inner side perspective view of a carry bag for rifles in a folded-out configuration, according to an embodiment of the invention.
Figure 3:
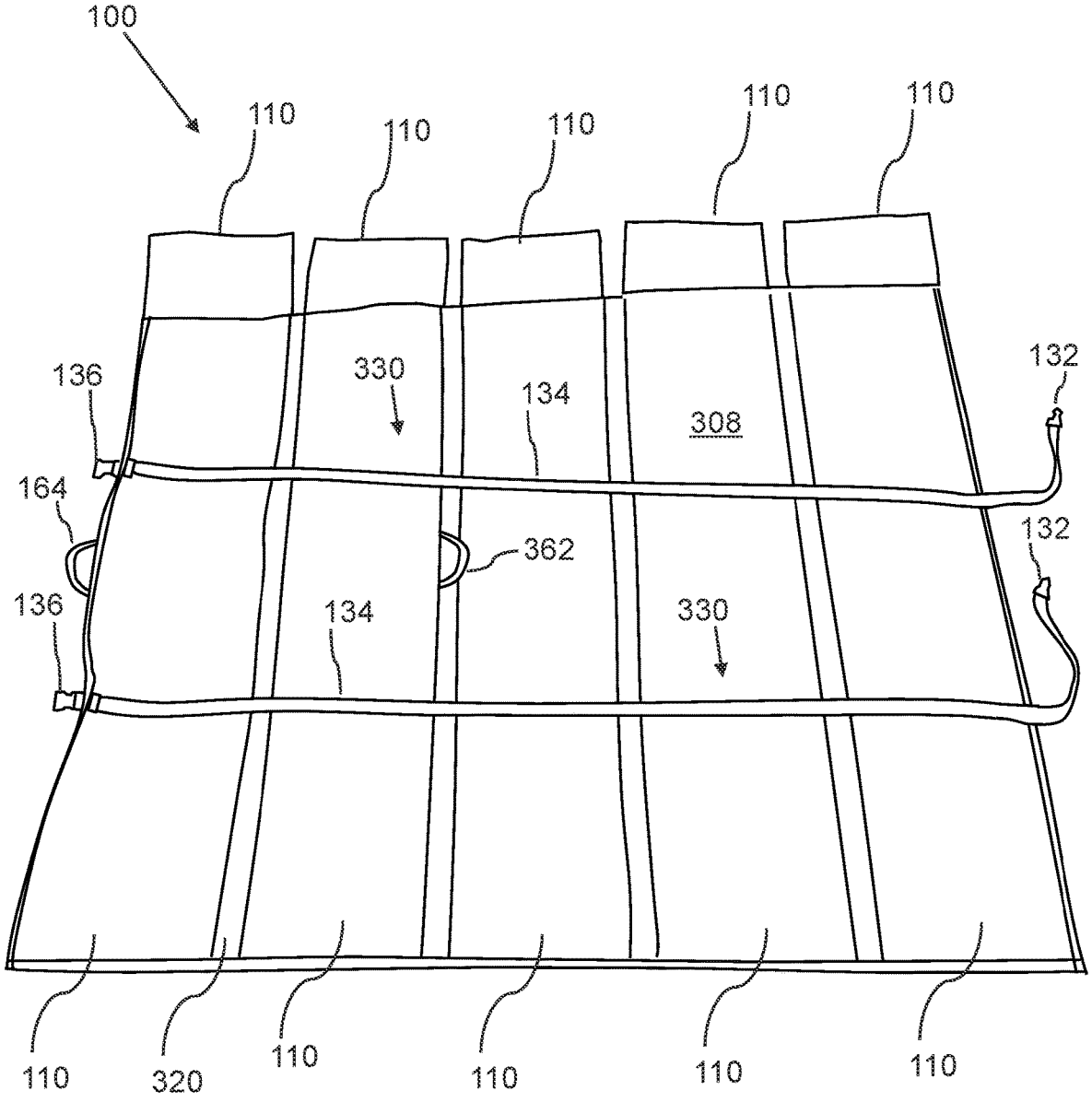
FIG. 3 is an outer side perspective view of a carry bag for rifles in a folded-out configuration, according to an embodiment of the invention.
Figure 5A:
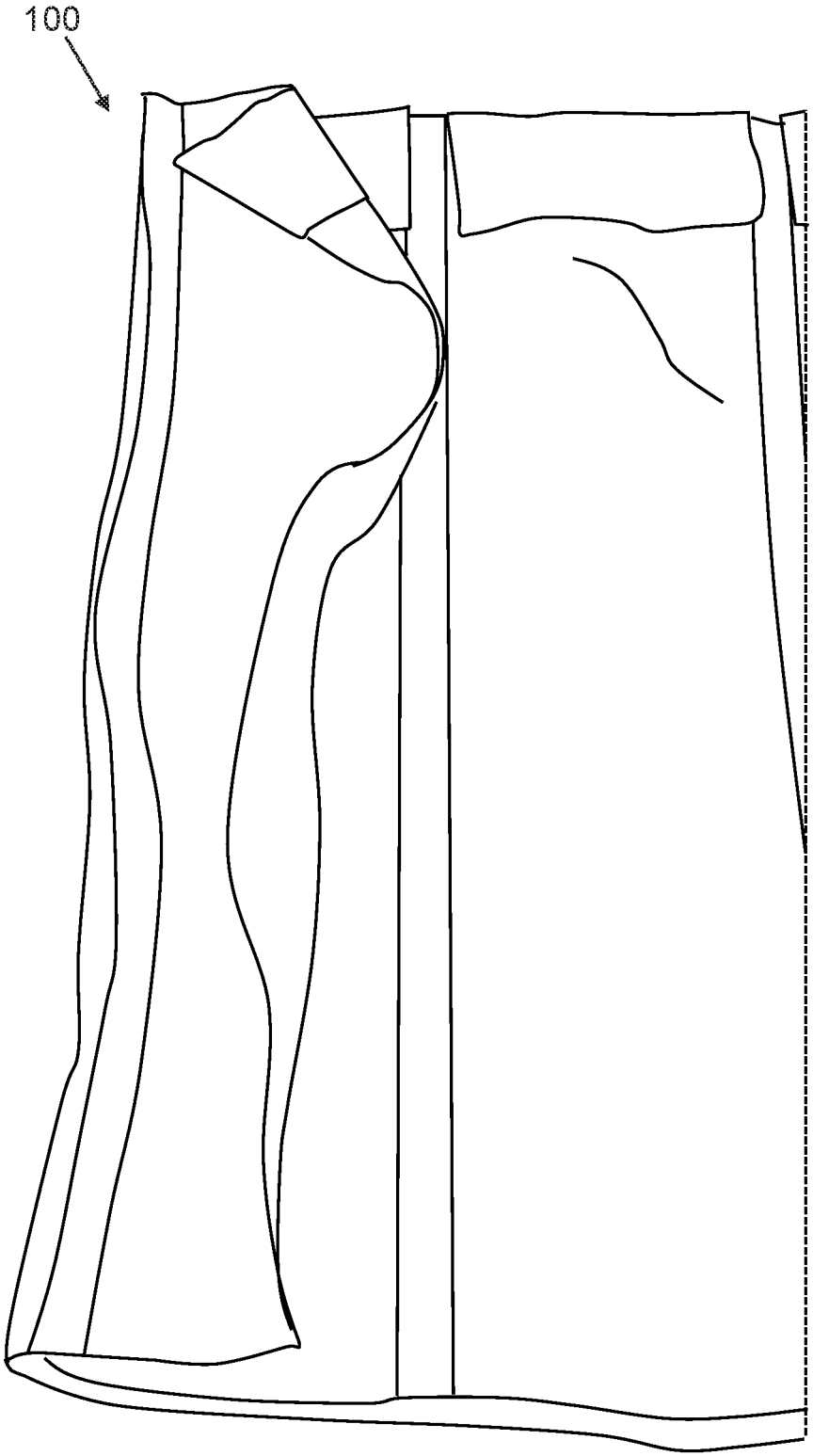
FIG. 5A is an inner side perspective view of a carry bag for rifles in a partially folded-up configuration, according to an embodiment of the invention.
Figure 5B:
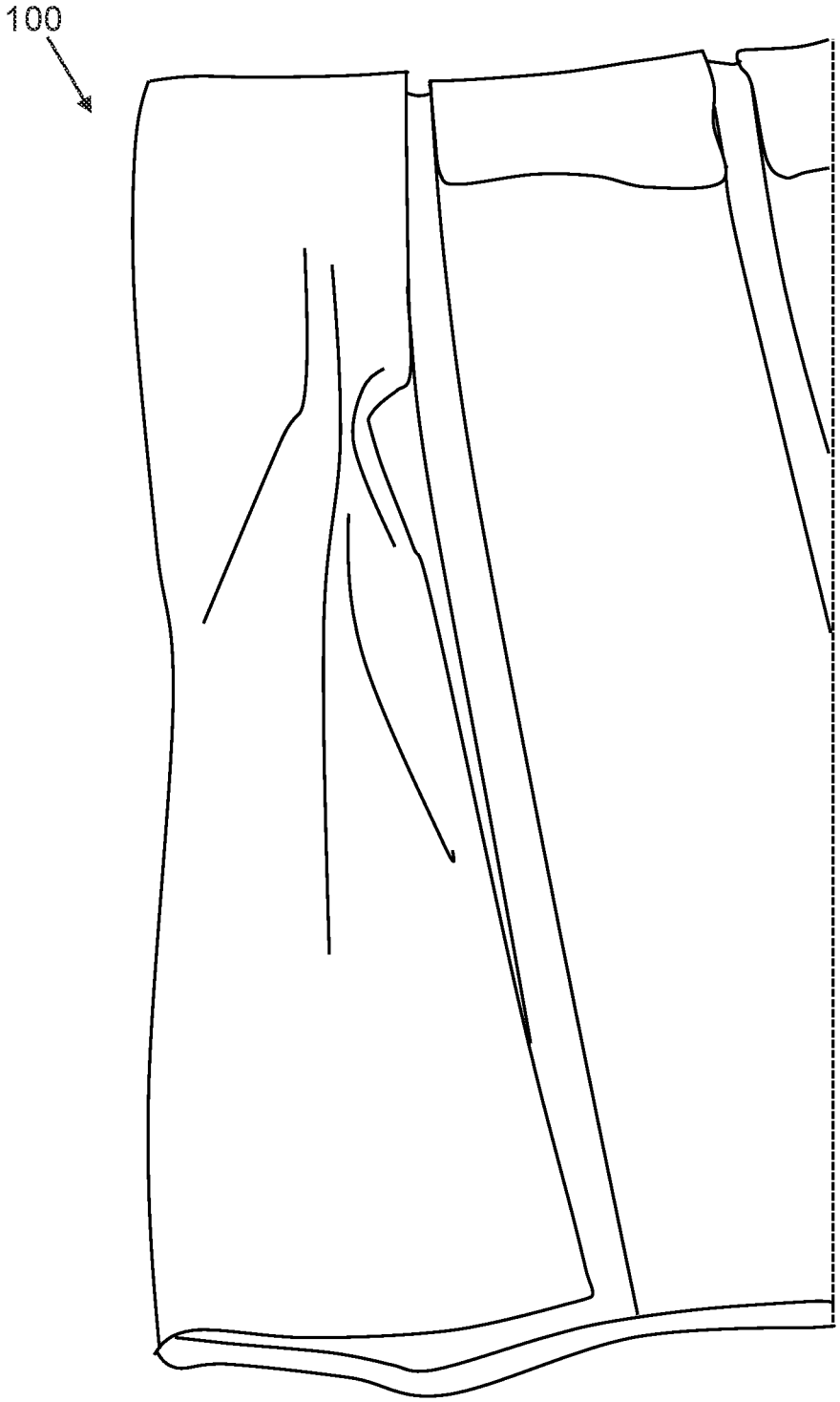
FIG. 5B is an inner side perspective view of a carry bag for rifles in a partially folded-up configuration, according to an embodiment of the invention.
Figure 5C:
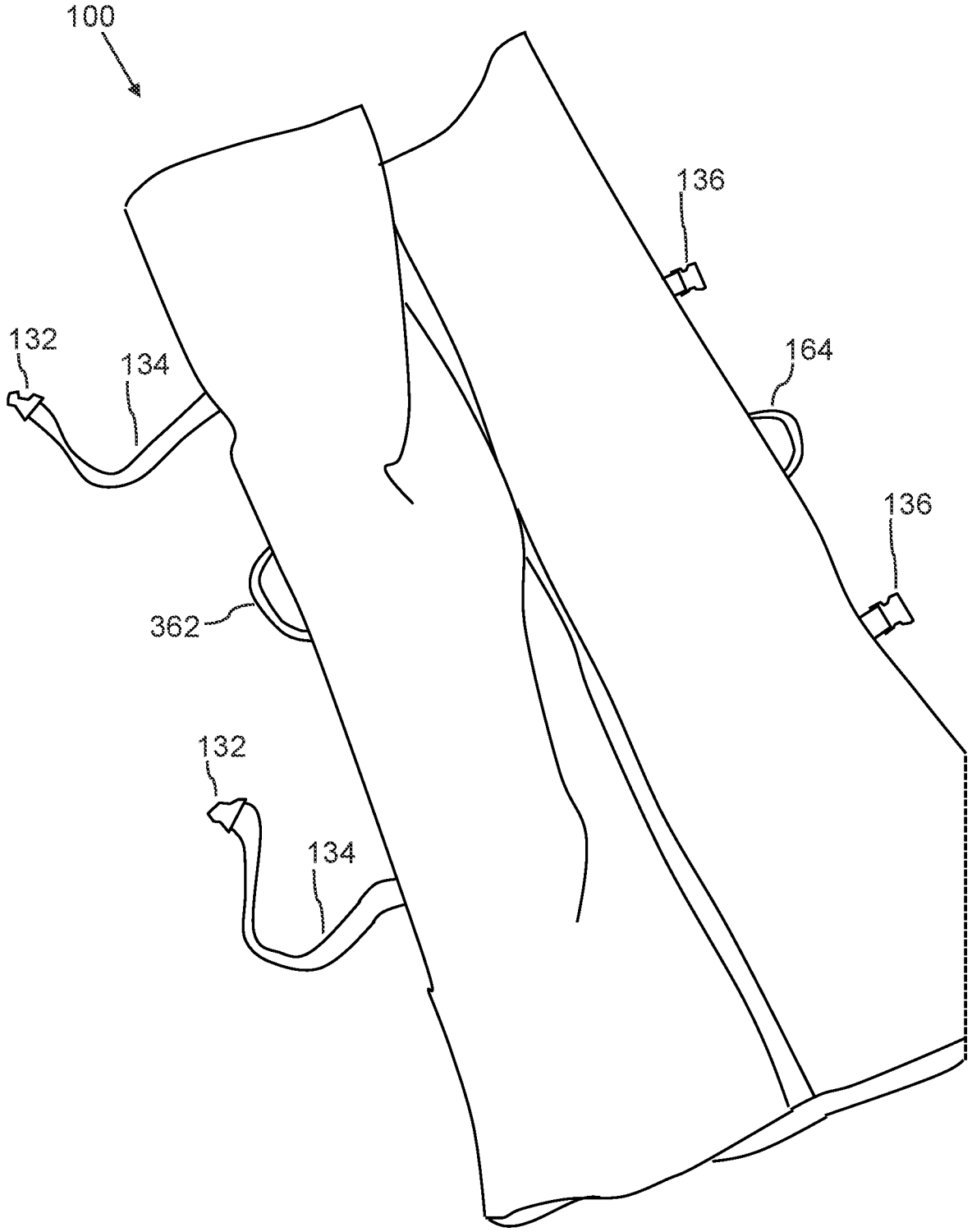
FIG. 5C is an inner side perspective view of a carry bag for rifles in a partially folded-up configuration, according to an embodiment of the invention.

In an example embodiment, the rifle carry bag 100 can include five elongated rifle pockets 110, each approximately 27.94 cm (11") wide and 121.92 cm (48") long. Each pocket can be designed to carry a rifle or shotgun and closes at the top with a flap 112. The rifle carry bag 100 can also include additional smaller pockets 414 (for example approx. 25.4 cm [10"]×50.8 cm [20"]) used for carrying magazines, cartridges, scopes, pistols, range equipment and miscellaneous shooting accessories. Each rifle pocket 110 can be separated by a conjoining gap of 3.81 cm (1.5") wide, in order to allow for continuous rolling of the filled rifle carry bag 100 from left to right (when facing the open pockets from an inside bottom point of view, such as shown in FIG. 1). The 5th pocket 110, however, can be approximately 30.48 cm (12") wide in order to accommodate the necessary overlap of the completed rolled up rifle carry bag 100, and in order to accommodate an outside handle 164 and two female strap couplers 136. Once rolled, two elongated length-adjustable straps 134 can be employed around the rolled rifle carry bag 100 and two male strap couplers 132 can connect with the two female couplers 136 and tightened with the straps 134. An adjoining handle 362 can be sewn to the rear of the bag, as shown in FIG. 3, and meets the outside handle 164 upon closing, allowing for two balanced handles 362, 164 which provide even and secure weight displacement. A shoulder strap 440 can also be included for easy carrying. FIGS. 5A, 5B, 5C, shows stages of rolling up pockets 110 from left to right, with respect to an inner side view as shown in FIGS. 1-2. FIG. 5A shows the rifle carry bag 100 with one leftmost rifle pocket 110 rolled up. FIG. 5B shows the rifle carry bag 100 with two leftmost rifle pockets 110 rolled up. FIG. 5C shows the rifle carry bag 100 with four pockets 110 rolled up, prior to final folding of the rifle carry bag 100.

In various embodiments, whereas most traditional soft and hard gun cases are made for a single firearm, the rifle carry bag 100 utilizes a novel roll-up design and ten or more pockets to optimize capacity for easy carrying of multiple long-guns, firearms and accessories. This consolidated canvass unit is much more cost-effective and eliminates the need for multiple bags, cases and luggage, while saving the user substantial time and struggle loading and unloading multiple rifle cases when preparing for transport. In essence, the rifle carry bag 100 is a cheaper, easier, faster, and more efficient method of transporting multiple firearms and shooting accessories.

In a related embodiment, a rifle carry bag 100 can include:

a) a bag body 102, which comprises a plurality of rifle pockets 110, which are connected side by side, along a longitudinal direction 118 of the rifle pockets, such that each rifle pocket 110 in the plurality of rifle pockets 110 is configured to receive a rifle 180;

such that the rifle carry bag 100 is configured to be rolled up in a lateral direction 104, when the rifle pockets 110 are filled up with a corresponding plurality of rifles 180.

In a related embodiment, the rifle carry bag 100 can further include:

a) a plurality of gaps 120, which are positioned between each pair of rifle pockets 110.

In a related embodiment, each gap 120 in the plurality of gaps 120 can have a width in a range of 0.635-25.4 centimeter (0.25-10 inches).

Figure 7:
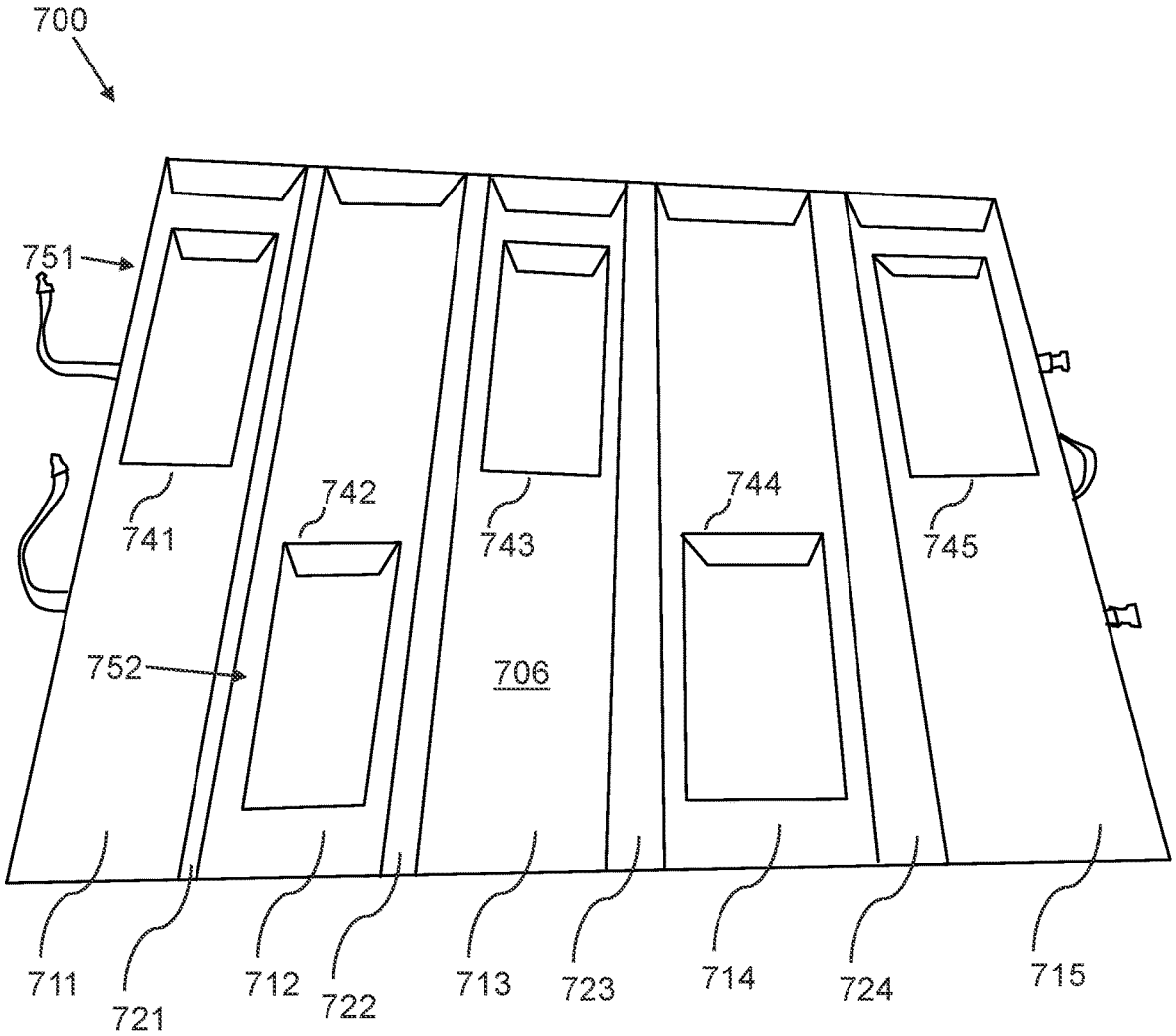
FIG. 7 is an inner side perspective view of a carry bag for rifles in a folded-out configuration, according to an embodiment of the invention.

In a related embodiment, as shown in FIG. 7, in order to facilitate roll-up of the rifle carry bag 100 with rifles stacked on top of each other, each gap 721, 722, 723, 724 in the plurality of gaps can have a progressively increasing width from a first to a second side (in a lateral direction 104, including from a left to a right side, as seen from inside view, as in FIG. 7) of the rifle carry bag 700.

In a related embodiment, as shown in FIG. 7, in order to facilitate roll-up of the rifle carry bag 100 with rifles stacked on top of each other, a rightmost gap 724 (or outermost gap 721, 724) can have a width 122, which is at least 2.54 centimeter (1 inch) wider than other gaps in the plurality of gaps. The remaining gaps 721, 722, 723, to a left of the rightmost gap 724 can have a uniform width or be progressively increasing.

In another related embodiment, as shown in FIG. 7, in order to facilitate roll-up of the rifle carry bag 700 with rifles stacked on top of each other, each pocket 711, 712, 713, 714, 715 in the plurality of rifle pockets can have a progressively increasing width from a first to a second side (in a lateral direction 104, including from a left to a right side, as seen from inside view, as in FIG. 7) of the rifle carry bag 700.

In yet another related embodiment, as shown in FIG. 8, the rifle carry bag 800 can be configured without gaps, and may further be configured such that each rifle pocket 811, 812, 813, 814, 815 in the plurality of rifle pockets can have a progressively increasing width 822, 824 from a first to a second side (in a lateral direction 104, including from a left to a right side, as seen from inside view, as in FIG. 8) of the rifle carry bag 800, in order to facilitate roll-up of the rifle carry bag 800 with rifles stacked on top of each other.

In a related embodiment, as shown in FIG. 8, a rightmost rifle pocket 815 (or outermost rifle pocket 811, 815) can have a width 824, which is at least 2.54 centimeter (1 inch) wider than other rifle pockets 811, 812, 813, 814 in the plurality of rifle pocket 811, 812, 813, 814, 815. The other rifle pockets 811, 812, 813, 814, to a left of the rightmost rifle pocket 815 can have a uniform width or be progressively increasing.

In a related embodiment, the bag body 102 can be made from a plastic material with a ballistic weave. The plastic material can for example be made from nylon or polyester, or a combination of these.

In a related embodiment, the plastic material can include a nylon material.

In various related embodiments, the rifle carry bag 100 can have two to ten rifle pockets 110, 2-15 rifle pockets 110, 3-15 rifle pockets 110, or more, such as up to 20 rifle pockets.

In a related embodiment, the rifle carry bag 100 can be configured five rifle pockets 110, such that the plurality of rifle pockets 110 is five rifle pockets 110.

In a related embodiment, as seen in FIG. 3, the rifle carry bag 100 can further include at least one elongated strap assembly 330, which can include:

a) an elongated strap 134, wherein the at least one elongated strap 134 is connected in a first end to an outer side surface 308 of the bag body 102;

b) a first strap connector 132, which is connected to a second end of the at least one elongated strap 134;

c) a second strap connector 136, which is connected to a second end side of the bag body 102;

such that the first strap connector 132 is detachably connectable to the second strap connector 136 when the rifle carry bag 100 is rolled up.

In a related embodiment, the rifle carry bag 100 can further include:

a) a first handle 164 which is connected to a first end side of the bag body 102; and b) a second handle 362, which is connected to an outer side surface 308 of the bag body 102;

such that the first handle and the second handle are adjacent when the rifle carry bag is rolled up, whereby the rifle carry bag is configured to be lifted in the first handle and the second handle.

Figure 4:
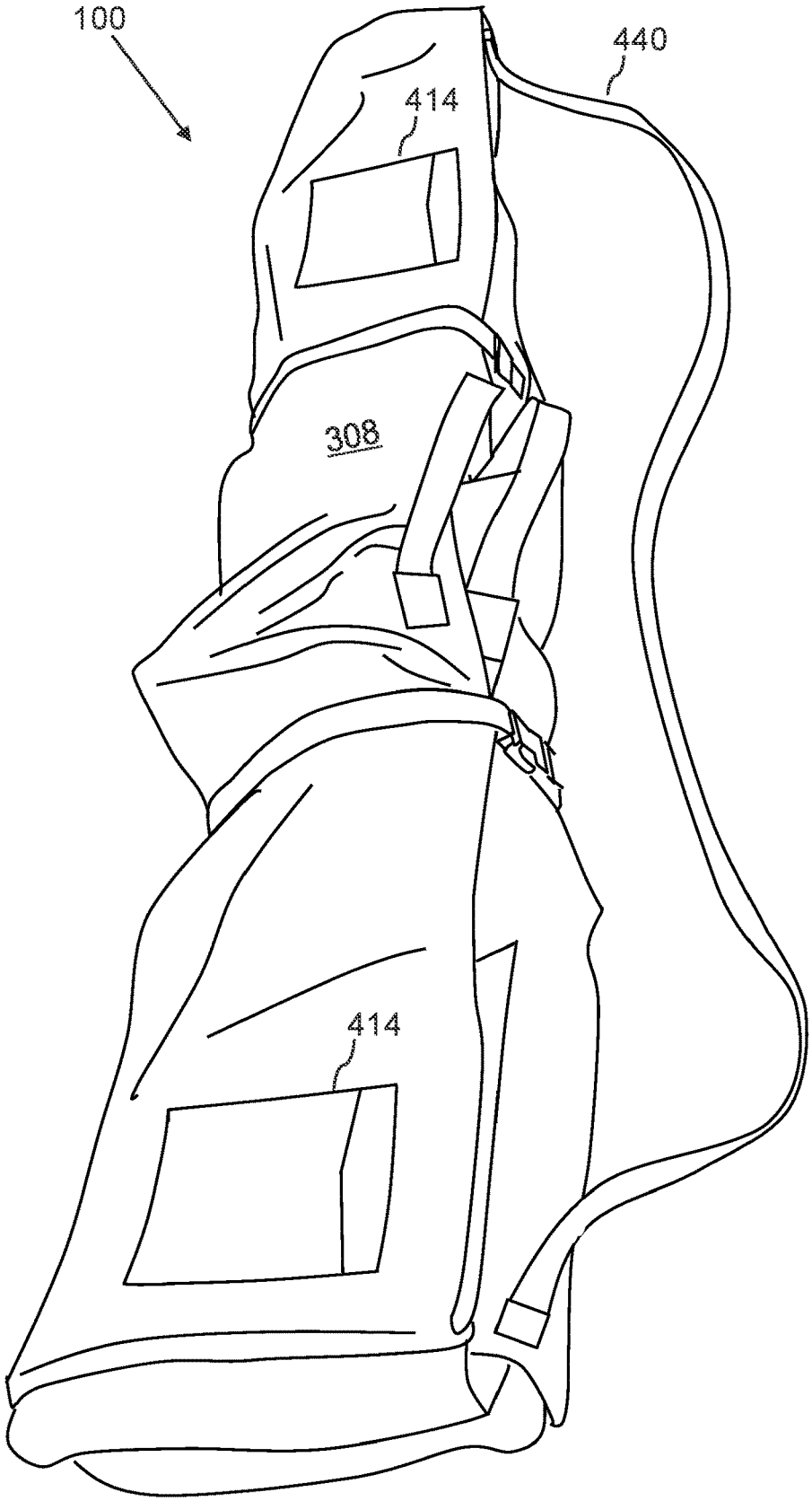
FIG. 4 is a perspective view of a carry bag for rifles in a folded-up configuration, according to an embodiment of the invention.

In a related embodiment, the rifle carry bag 100 can further include:

a) a shoulder strap 440, wherein first and second ends of the shoulder strap are connected to a first side of the bag body 102;

whereby the rifle carry bag 100 is configured to be carried in the shoulder strap 440 when the rifle carry bag 100 is rolled up, as shown in FIG. 4.

In a related embodiment, as shown in FIG. 4, the rifle carry bag 100 can further include:

a) at least one exterior accessory pocket 414, which is positioned on an outer side surface 308 of the bag body 102, such that the at least one exterior accessory pocket 414 is configured to be accessible when the rifle carry bag 100 is rolled up, such that the at least one exterior accessory pocket 414 can be configured to contain one or more firearm magazines, firearm cartridges, scopes, pistols, range equipment, and/or other shooting accessories.

In a related embodiment, as shown in FIG. 7, the rifle carry bag 100 can further include:

a) at least one interior accessory pocket 741, which is positioned on an inner side surface 106, 706 of the bag body 102, such that the at least one interior accessory pocket 741 is configured to be accessible when the rifle carry bag 100 is rolled open, such that the at least one interior accessory pocket 741 can be configured to contain one or more firearm magazines, firearm cartridges, scopes, pistols, range equipment, and/or other shooting accessories.

In a further related embodiment, as shown in FIG. 7, the at least one interior accessory pocket 741 can be oriented along a longitudinal direction 118 of an inner side surface 106, 706 of a rifle pocket 110.

In a further related embodiment, as shown in FIG. 7, the at least one interior accessory pocket 741 can include a plurality of interior accessory pockets 741, 742, 743, 744, 745, which are positioned in a staggered layout, such that the interior accessory pockets 741 alternate (along a lateral direction 104 of the rifle carry bag 100) between top and bottom positions 751, 752 on the inner side surface 106, 706 of the rifle pockets 110 with respect to the longitudinal direction 118 of the rifle pockets, including staring from top position 751 to bottom position 752 (as shown) or starting from bottom position 752 to top position 751.

In a related embodiment, as shown in FIG. 1, each corresponding rifle pocket 110 can further include:

a) an interior ballistic pouch 114, which is positioned in a bottom of the corresponding rifle pocket 110 in the plurality of rifle pockets 110, such that the interior ballistic pouch 114 is configured such that a muzzle 182 of the rifle 180 is positionable within the interior ballistic pouch 114, when the rifle 180 is positioned within the corresponding rifle pocket 110;

wherein the interior ballistic pouch 114 is made from a ballistic material, which is configured to retain a projectile 184 fired from the rifle (i.e. stop the projectile), such that projectile does not penetrate the interior ballistic pouch 114 and remains within an interior of the interior ballistic pouch 114 (or the interior ballistic pouch 114 at least significantly reduces/absorbs kinetic energy of the projectile 184), to provide a safety mitigation against accidental or malicious discharge when a rifle 180 has been improperly stored with a chambered round.

In a further related embodiment, the interior ballistic pouch 114 can be made from a ballistic material, which comprises KEVLAR™, generically known as poly-paraphenylene terephthalamide, wherein the ballistic material can include a composite material, which is reinforced with poly-paraphenylene terephthalamide.

Figure 9A:
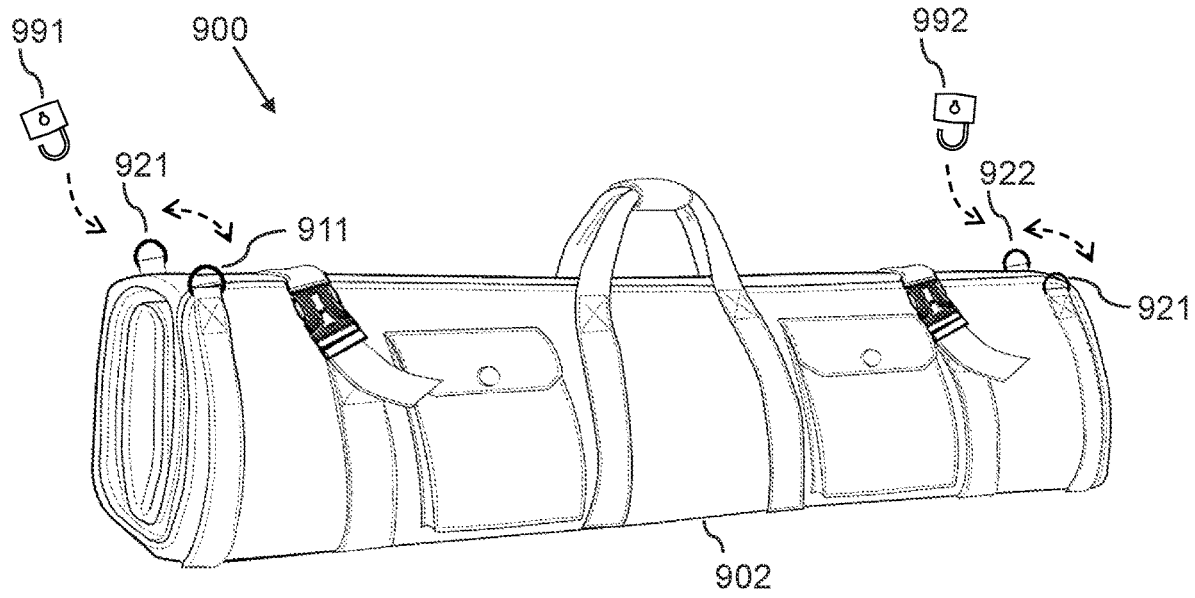
FIG. 9A is a perspective view of a carry bag for rifles in a folded-up configuration, prior to locking with padlocks, according to an embodiment of the invention.
Figure 9B:
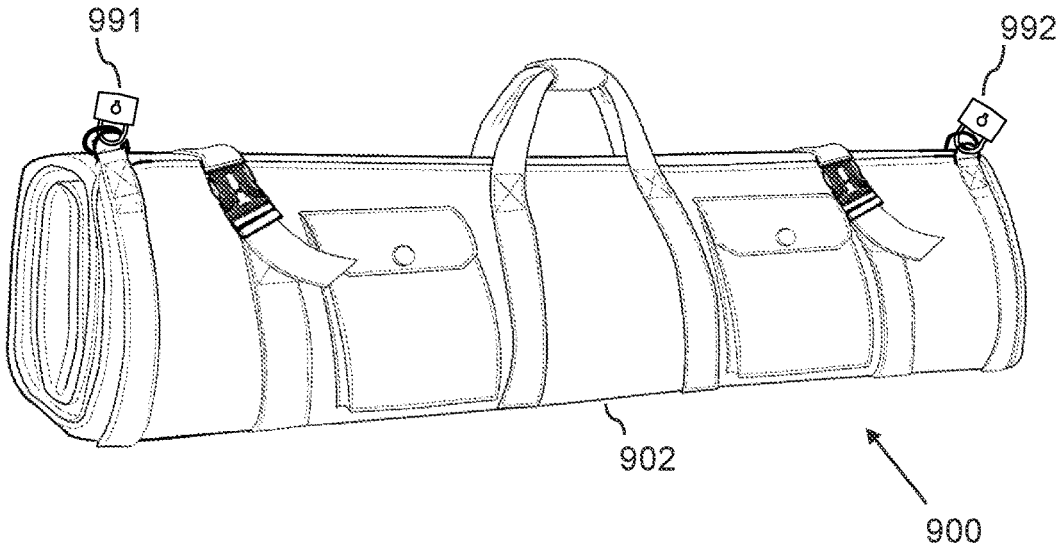
FIG. 9B is a perspective view of a carry bag for rifles in a folded-up configuration, which is locked with padlocks, according to an embodiment of the invention.
Figure 9C:
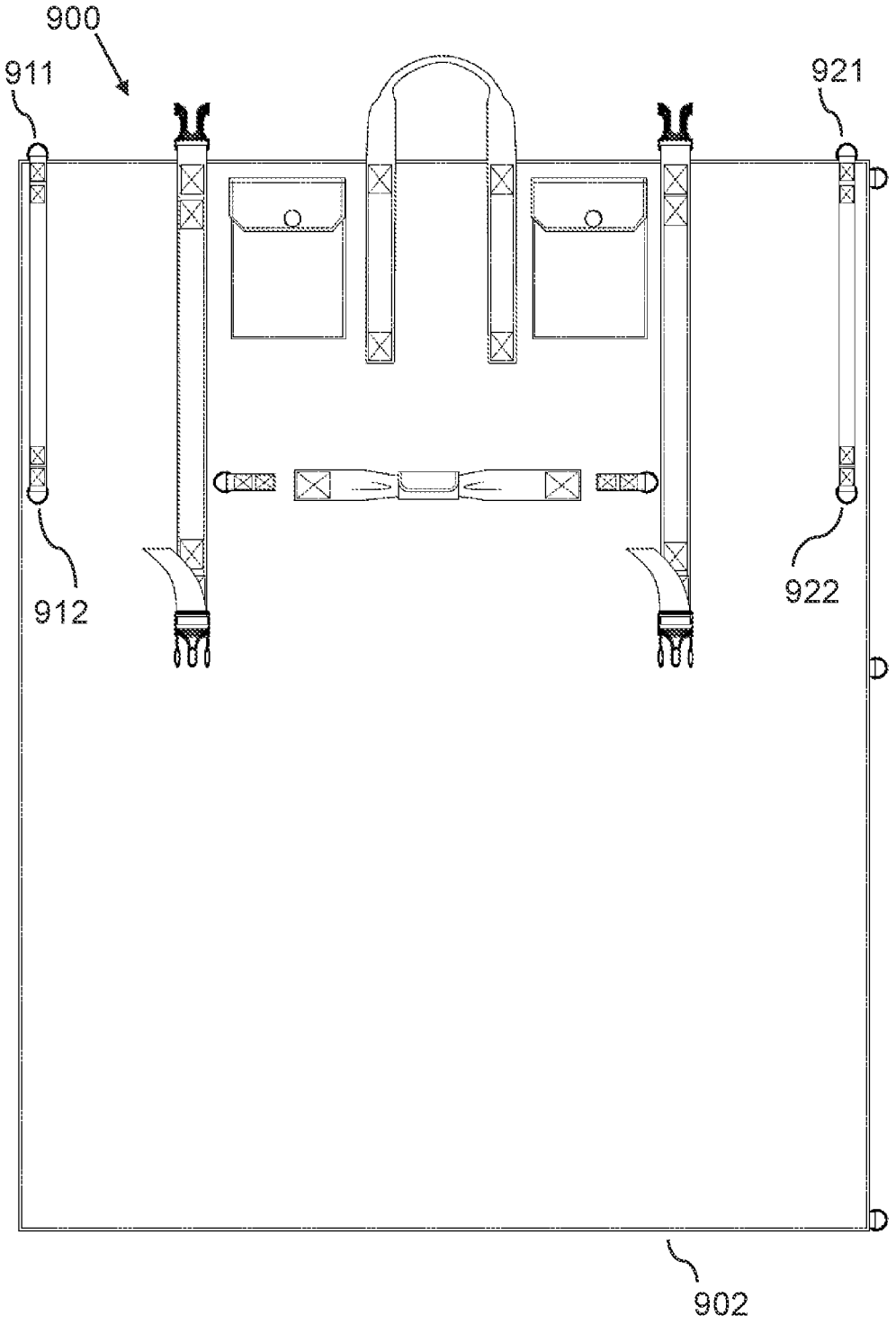
FIG. 9C is an outer side view of a carry bag for rifles in a folded-out configuration, according to an embodiment of the invention.
Figure 9D:
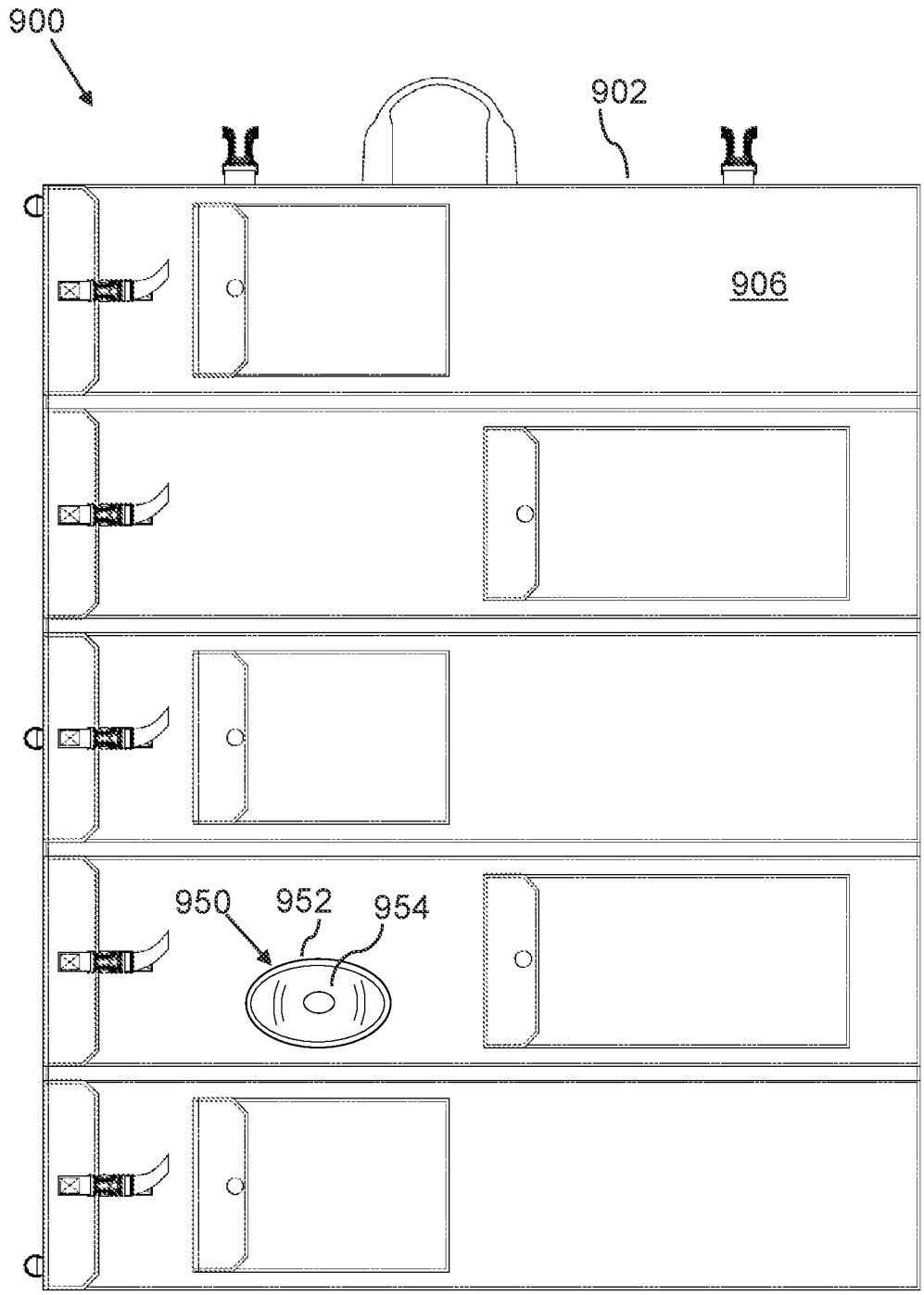
FIG. 9D is an inner side view of a carry bag for rifles in a folded-out configuration, according to an embodiment of the invention.
Figure 9E:
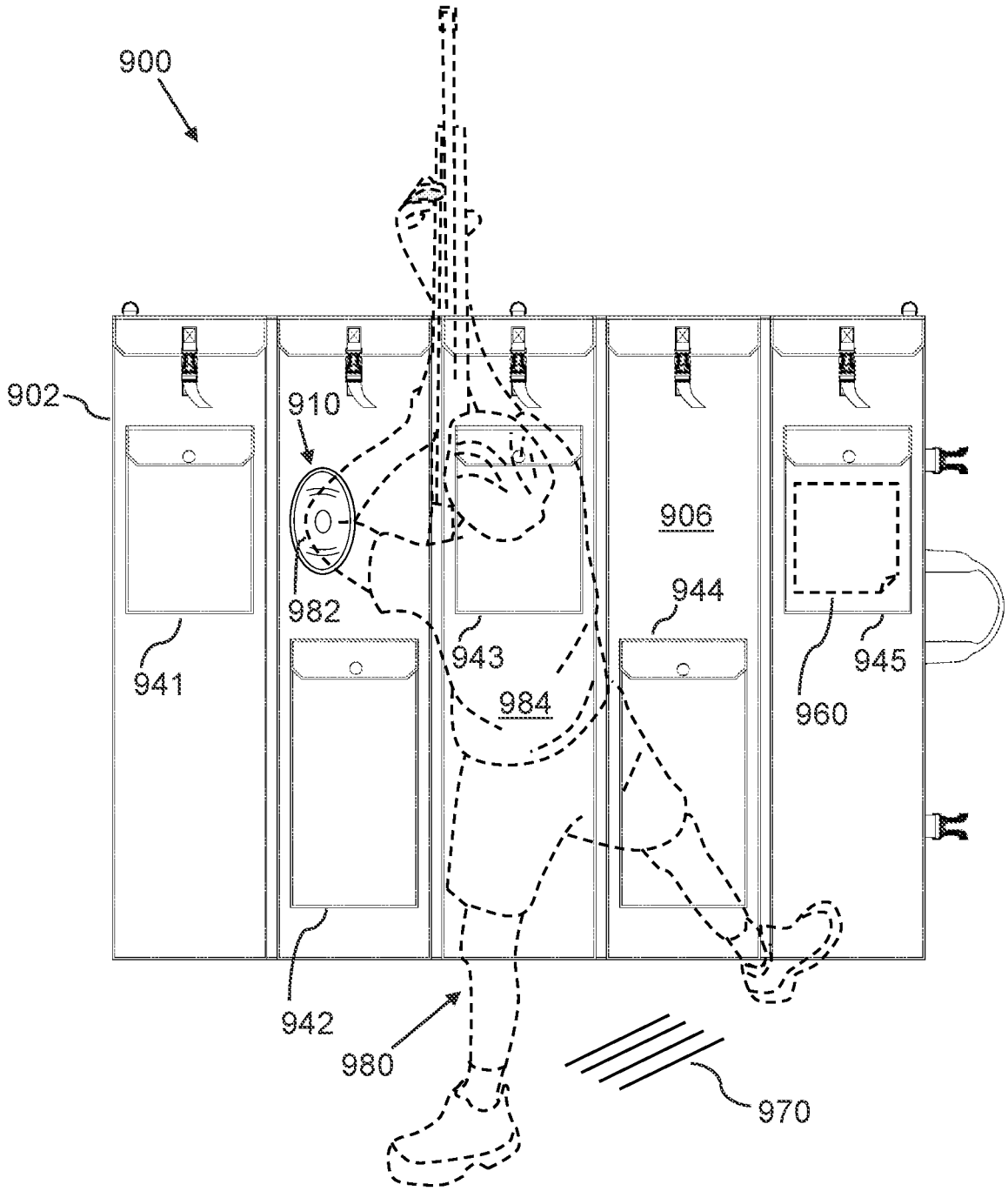
FIG. 9E is an inner side view of a carry bag for rifles in a folded-out configuration during use for target practice, according to an embodiment of the invention.

In a related embodiment, as shown in FIGS. 9D and 9E, the rifle carry bag 900 can further include:

a) an elbow pad 950, which can be positioned on a surface of the bag body 902, such that the elbow pad 950 is configured to support an elbow 982 of a user 980, wherein the elbow pad 950 can be made from a synthetic or natural rubber material and can further include:

i. an outer rounded peripheral rim 952; and ii. an interior concave surface 954, which is positioned inside the outer rounded peripheral rim 952, such that the interior concave surface 954 is outward facing (i.e. exposed for use on the surface 106, 706, 906 of the bag body 902);

such that the interior concave surface 954 provides a comfortable and secure grip of the elbow 982 of the user 980.

such that the rifle carry bag 900 can be used for shooting in a prone position, such that the elbow 982 of the user/shooter 980 is positionable on the elbow pad 950, when the rifle carry bag 900 is rolled-out flat, in a rolled-out configuration on a ground surface 970.

In a related embodiment, the elbow pad 950 can be positioned on an inner side surface 106, 706, 906 of the bag body 902, wherein the staggered layout (of the interior accessory pockets) can be configured such that the elbow pad 950 is positioned between a first top interior accessory pocket 941 and a second top interior accessory pocket 943, and such that a lower torso 984 (typically the stomach area) of the user 980 is positionable between a first bottom interior accessory pocket 942 and a second bottom interior accessory pocket 944.

In a related embodiment, at least one interior accessory pocket 941, 942, 943, 944, 945 of the interior accessory pockets 941, 942, 943, 944, 945 can be made from a fire-retardant material, such that at least one interior accessory pocket 941, 942, 943, 944, 945 can be used for storage of fire sensitive materials, such as documents 960, firearm rounds, etc.

In a related embodiment, as shown in FIGS. 9A-9B and 9C, the rifle carry bag 900 can further include lock connectors, which are configured to lock the rifle carry bag 900 (for example using one or more padlocks 991, 992), when the rifle carry bag 900 is rolled up (in the rolled-up configuration), as shown in FIGS. 9A and 9B, wherein the lock connectors can include:

a) a first left lock connector 911, which is positioned on a left side of an outer end of the bag body 902, wherein the first left lock connector 911, can be configured as a D-ring, i.e. such that the first left lock connector 911 is ring-shaped with a D-shape;

b) a second left lock connector 912, which is positioned on a left side of an outer side of the bag body 902, wherein the second left lock connector 912, can be configured as a D-ring, i.e. such that the second left lock connector 912 is ring-shaped with a D-shape;

c) a first right lock connector 921, which is positioned on a right side of an outer end of the bag body 902, wherein the first right lock connector 921, can be configured as a D-ring, i.e. such that the first right lock connector 921 is ring-shaped with a D-shape; and d) a second right lock connector 922, which is positioned on a right side of an outer side of the bag body 902, wherein the second right lock connector 922, can be configured as a D-ring, i.e. such that the second right lock connector 922 is ring-shaped with a D-shape;

such that the first left lock connector 911 and the second left lock connector 912 are laterally aligned, such that the first left lock connector 911 and the second left lock connector 912 are configured to be adjacently positionable and interlockable, such that the first left lock connector 911 and the second left lock connector 912 are configured to be lockable with a first padlock 991 when the rifle carry bag 900 is rolled up (in the rolled-up configuration), as shown in FIG. 9B; and such that the first right lock connector 921 and the second right lock connector 922 are laterally aligned, such that the first right lock connector 921 and the second right lock connector 922 are configured to be adjacently positionable and interlockable, such that the first right lock connector 921 and the second right lock connector 922 are configured to be lockable with a second padlock 992 when the rifle carry bag 900 is rolled up (in the rolled-up configuration), as shown in FIG. 9B.

In alternative embodiments, each of the first and second left lock connectors 911, 912 and the first and second right lock connectors 921, 922 can be configured to interlock with various well-known locking mechanisms, including with a snap-lock locking mechanism that is lockable with a key or keypad combination (when the locking mechanism is a combination lock).

In a further related embodiment, the bag body 102 can be made from a cut-resistant material, such as a weaved cut-resistant fabric, which can be a composite material, which comprises which comprises KEVLAR™, generically known as poly-paraphenylene terephthalamide, such that the cut-resistant material can prevent (i.e. resist or reduce risk of) penetration into the rifle carry bag 100 with a knife or other sharp object, such that the cut-resistant material is configured to prevent penetration into the rifle carry bag 900 when the rifle carry bag 900 is rolled up and locked.

Here has thus been described a multitude of embodiments of rifle carry bag 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A rifle carry bag, comprising:

a bag body, which comprises a plurality of rifle pockets, which are connected side by side, along a longitudinal direction of the rifle pockets, such that each rifle pocket in the plurality of rifle pockets is configured to receive a rifle;

a plurality of gaps, such that each gap in the plurality of gaps is positioned between a corresponding pair of rifle pockets, such that the plurality of gaps create a visible separation among contiguous rifle pockets when the rifle carry bag is unrolled; and an elbow pad, which is positioned on a surface of the bag body, such that the elbow pad is configured to support an elbow of a user;

such that the rifle carry bag is configured to be used for shooting in a prone position, such that an elbow of a user is positionable on the elbow pad, when the rifle carry bag is rolled-out flat;

wherein the elbow pad further comprises:

an interior concave surface, which is outward facing;

such that the interior concave surface is configured to provide a comfortable and secure grip of the elbow of the user;

such that the rifle carry bag is configured to be rolled up in a lateral direction, when the rifle pockets are filled up with a corresponding plurality of rifles;

wherein each gap in the plurality of gaps has a progressively increasing width from a first side to a second side of the rifle carry bag, such that the rifle carry bag is configured to facilitate roll-up of the rifle carry bag with the rifles stacked on top of each other.

2. The rifle carry bag of claim 1, wherein an outermost gap has a width, which is at least 2.54 centimeter (1 inch) wider than other gaps in the plurality of gaps.

3. The rifle carry bag of claim 1, wherein each rifle pocket in the plurality of rifle pockets has a progressively increasing width from a first side to a second side of the rifle carry bag.

4. The rifle carry bag of claim 1, wherein an outermost rifle pocket has a width, which is at least 2.54 centimeter (1 inch) wider than other rifle pockets in the plurality of rifle pockets.

5. The rifle carry bag of claim 1, further comprising:

at least one exterior accessory pocket, which is positioned on an outer side surface of the bag body, such that the at least one exterior accessory pocket is configured to be accessible when the rifle carry bag is rolled up.

6. The rifle carry bag of claim 1, further comprising:

at least one interior accessory pocket, which is positioned on an inner side surface of the bag body, such that the at least one interior accessory pocket is configured to be accessible when the rifle carry bag is rolled open.

7. The rifle carry bag of claim 6, wherein the at least one interior accessory pocket comprises a plurality of interior accessory pockets, which are positioned in a staggered layout, such that the interior accessory pockets alternate between top and bottom positions on the inner side surface of the rifle pockets with respect to the longitudinal direction of the rifle pockets.

8. The rifle carry bag of claim 1, further comprising:

at least one interior ballistic pouch, which is positioned in a bottom of a corresponding rifle pocket in the plurality of rifle pockets, such that the interior ballistic pouch is configured such that a muzzle of the rifle is positionable within the interior ballistic pouch, when the rifle is positioned within the corresponding rifle pocket;

wherein the interior ballistic pouch is made from a ballistic material, which is configured to retain a projectile fired from the rifle.

9. The rifle carry bag of claim 8, wherein the ballistic material comprises poly-paraphenylene terephthalamide.

10. The rifle carry bag of claim 1, further comprising:

a plurality of interior accessory pockets, which are positioned on an inner side surface of the bag body, such that the interior accessory pockets are configured to be accessible when the rifle carry bag is rolled open;

wherein the interior accessory pockets are positioned in a staggered layout, such that the interior accessory pockets alternate between top and bottom positions on the inner side surface of the rifle pockets with respect to the longitudinal direction of the rifle pockets;

wherein the elbow pad is positioned on the inner side surface of the bag body;

wherein the staggered layout is configured such that the elbow pad is positioned between a first top interior accessory pocket and a second top interior accessory pocket, and such that a lower torso of the user is positionable between a first bottom interior accessory pocket and a second bottom interior accessory pocket.

11. The rifle carry bag of claim 1, further comprising:

(a) a first left lock connector, which is positioned on a left side of an outer end of the bag body;

(b) a second left lock connector, which is positioned on a left side of an outer side of the bag body;

(c) a first right lock connector, which is positioned on a right side of the outer end of the bag body; and (d) a second right lock connector, which is positioned on a right side of an outer side of the bag body;

such that the first left lock connector and the second left lock connector are laterally aligned, such that the first left lock connector and the second left lock connector are configured to be adjacently positionable and interlockable when the rifle carry bag is rolled up; and such that the first right lock connector and the second right lock connector are laterally aligned, such that the first right lock connector and the second right lock connector are configured to be adjacently positionable and interlockable, when the rifle carry bag is rolled up.

12. The rifle carry bag of claim 11, wherein the first left lock connector and the second left lock connector are ring-shaped, such that the first left lock connector and the second left lock connector are configured to be lockable with a first padlock; and wherein the first right lock connector and the second right lock connector are ring-shaped, such that the first right lock connector and the second right lock connector are configured to be lockable with a second padlock.

13. The rifle carry bag of claim 12, wherein the bag body is made from a cut-resistant material, such that the cut-resistant material is configured to prevent penetration into the rifle carry bag when the rifle carry bag is rolled up and locked.

14. A rifle carry bag, comprising:

a plurality of rifle pockets, which are connected side by side, along a longitudinal direction of the rifle pockets, such that each rifle pocket in the plurality of rifle pockets is configured to receive a rifle;

an elbow pad, defined by an outer rim, wherein the elbow pad is positioned on a surface of the bag body, such that the elbow pad is configured to support an elbow of a user; and a plurality of interior accessory pockets, which are positioned on an inner side surface of the bag body, such that the interior accessory pockets are configured to be accessible when the rifle carry bag is rolled open;

such that the rifle carry bag is configured to be used for shooting in a prone position, such that an elbow of a user is positionable on the elbow pad, when the rifle carry bag is rolled-out flat;

wherein the interior accessory pockets are positioned in a staggered layout, such that the interior accessory pockets alternate between top and bottom positions on the inner side surface of the rifle pockets with respect to the longitudinal direction of the rifle pockets;

wherein the elbow pad is positioned on the inner side surface of the bag body;

wherein the staggered layout is configured such that the elbow pad is positioned between a first top interior accessory pocket and a second top interior accessory pocket, and such that a lower torso of the user is positionable between a first bottom interior accessory pocket and a second bottom interior accessory pocket;

such that the rifle carry bag is configured to be rolled up in a lateral direction, when the rifle pockets are filled up with a corresponding plurality of rifles.

15. The rifle carry bag of claim 14, further comprising:

a plurality of gaps, which are positioned between each pair of rifle pockets, such that the plurality of gaps create a visible separation among contiguous rifle pockets when the rifle carry bag is unrolled;

wherein each gap in the plurality of gaps has a progressively increasing width from a first side to a second side of the rifle carry bag.

16. The rifle carry bag of claim 14, wherein each rifle pocket in the plurality of rifle pockets has a progressively increasing width from a first side to a second side of the rifle carry bag.

17. The rifle carry bag of claim 1, wherein the plurality of rifle pockets comprises five rifle pockets.

18. A rifle carry bag, comprising:

a bag body, which comprises a plurality of rifle pockets, which are connected side by side, along a longitudinal direction of the rifle pockets, such that each rifle pocket in the plurality of rifle pockets is configured to receive a rifle;

a first left lock connector, which is positioned on a left side of an outer end of the bag body;

a second left lock connector, which is positioned on a left side of an outer side of the bag body;

a first right lock connector, which is positioned on a right side of the outer end of the bag body; and a second right lock connector, which is positioned on a right side of an outer side of the bag body;

such that the first left lock connector and the second left lock connector are laterally aligned, such that the first left lock connector and the second left lock connector are configured to be adjacently positionable and interlockable when the rifle carry bag is rolled up;

such that the first right lock connector and the second right lock connector are laterally aligned, such that the first right lock connector and the second right lock connector are configured to be adjacently positionable and interlockable, when the rifle carry bag is rolled up;

wherein the first left lock connector and the second left lock connector are ring-shaped, such that the first left lock connector and the second left lock connector are configured to be lockable with a first padlock; and wherein the first right lock connector and the second right lock connector are ring-shaped, such that the first right lock connector and the second right lock connector are configured to be lockable with a second padlock;

such that the rifle carry bag is configured to be rolled up in a lateral direction, when the rifle pockets are filled up with a corresponding plurality of rifles.

19. A rifle carry bag, comprising:

a bag body, which comprises a plurality of rifle pockets, which are connected side by side, along a longitudinal direction of the rifle pockets, such that each rifle pocket in the plurality of rifle pockets is configured to receive a rifle;

a plurality of gaps, such that each gap in the plurality of gaps is positioned between a corresponding pair of rifle pockets, such that the plurality of gaps create a visible separation among contiguous rifle pockets when the rifle carry bag is unrolled;

an elbow pad, which is positioned on a surface of the bag body, such that the elbow pad is configured to support an elbow of a user; and a plurality of interior accessory pockets, which are positioned on an inner side surface of the bag body, such that the interior accessory pockets are configured to be accessible when the rifle carry bag is rolled open;

such that the rifle carry bag is configured to be used for shooting in a prone position, such that an elbow of a user is positionable on the elbow pad, when the rifle carry bag is rolled-out flat;

such that the rifle carry bag is configured to be rolled up in a lateral direction, when the rifle pockets are filled up with a corresponding plurality of rifles;

wherein each gap in the plurality of gaps has a progressively increasing width from a first side to a second side of the rifle carry bag, such that the rifle carry bag is configured to facilitate roll-up of the rifle carry bag with the rifles stacked on top of each other;

wherein the interior accessory pockets are positioned in a staggered layout, such that the interior accessory pockets alternate between top and bottom positions on the inner side surface of the rifle pockets with respect to the longitudinal direction of the rifle pockets;

wherein the elbow pad is positioned on the inner side surface of the bag body;

wherein the staggered layout is configured such that the elbow pad is positioned between a first top interior accessory pocket and a second top interior accessory pocket, and such that a lower torso of the user is positionable between a first bottom interior accessory pocket and a second bottom interior accessory pocket.

* * * * *